United States Patent [19]

Wethern

[11] Patent Number: 4,615,623

[45] Date of Patent: Oct. 7, 1986

[54] IMPELLER FOR MIXING TANKS

[76] Inventor: Richard J. Wethern, 7795 SW. Hillcrest Pl., Beaverton, Oreg. 97005

[21] Appl. No.: 653,555

[22] Filed: Sep. 24, 1984

[51] Int. Cl.[4] ..... B01F 7/16

[52] U.S. Cl. ..... 366/279

[58] Field of Search ..... 416/227 R, 227 A; 366/279, 325, 331, 320

[56] References Cited

U.S. PATENT DOCUMENTS

| | | | |
|---|---|---|---|
| 1,492,448 | 4/1924 | Gotis | 366/325 |
| 2,022,711 | 12/1935 | Farrington | 366/279 |
| 3,156,451 | 11/1964 | Waas | 366/325 X |

FOREIGN PATENT DOCUMENTS

| | | | |
|---|---|---|---|
| 313977 | 7/1919 | Fed. Rep. of Germany | 366/325 |
| 354801 | 6/1922 | Fed. Rep. of Germany | 366/325 |
| 692849 | 6/1940 | Fed. Rep. of Germany | 366/325 |
| 1068737 | 6/1954 | France | 366/279 |

*Primary Examiner*—Robert E. Garrett
*Assistant Examiner*—Joseph M. Pitko
*Attorney, Agent, or Firm*—James D. Givnan, Jr.

[57] ABSTRACT

An impeller having blade members of arched configuration secured at their ends to a central support member such as an impeller shaft. Each blade member is twisted lengthwise through approximately 90 degrees to cause the blade members to produce a conical discharge flow. The blade members may be of unitary construction. A modified impeller blade has individually blade members mounted to a tubular support member. The impeller blade may be used in a multiple manner on a single support member.

5 Claims, 6 Drawing Figures

IMPELLER FOR MIXING TANKS

BACKGROUND OF THE INVENTION

The present invention pertains to impeller construction for use in a mixing tank.

In present mixing tanks it is common practice to utilize an impeller of propellor shape having blade members which propel the mixed materials in an axial flow. The absence of a substantial radial component to the flow delays the mixing of materials particularly when materials to be mixed are added to the uppermost level of the tank. The promoting of rapid mixing in a mixing tank by the tangential or inclined positioning of impellers and impellers shafts increases the cost of tank construction or modification.

SUMMARY OF THE PRESENT INVENTION

The present invention is embodied in impeller construction wherein blade members impart a conical flow pattern to the material to mix material in a tank regardless of the point of entry of the material.

The present impeller has blade members of elongate, arched configuration inside elevation with said members further having a rotational or twist imparted thereto during manufacture. The twisted blade members each act on the fluid to provide a discharge flow with vectors lying generally in a cone concentric with the rotational axis of the impeller.

Important objectives of the present impeller include the provision of an impeller having a flow discharge pattern conducive to the rapid mixing of materials in a tank; the provision of an impeller which imparts a conical flow pattern to fluid; the provision of an impeller which may be of unitary low cost materials and construction methods; the provision of an impeller which may be used in multiples on a single shaft.

DETAILED DESCRIPTION OF THE PREFERRED EMBODIMENTS

Figure 1:
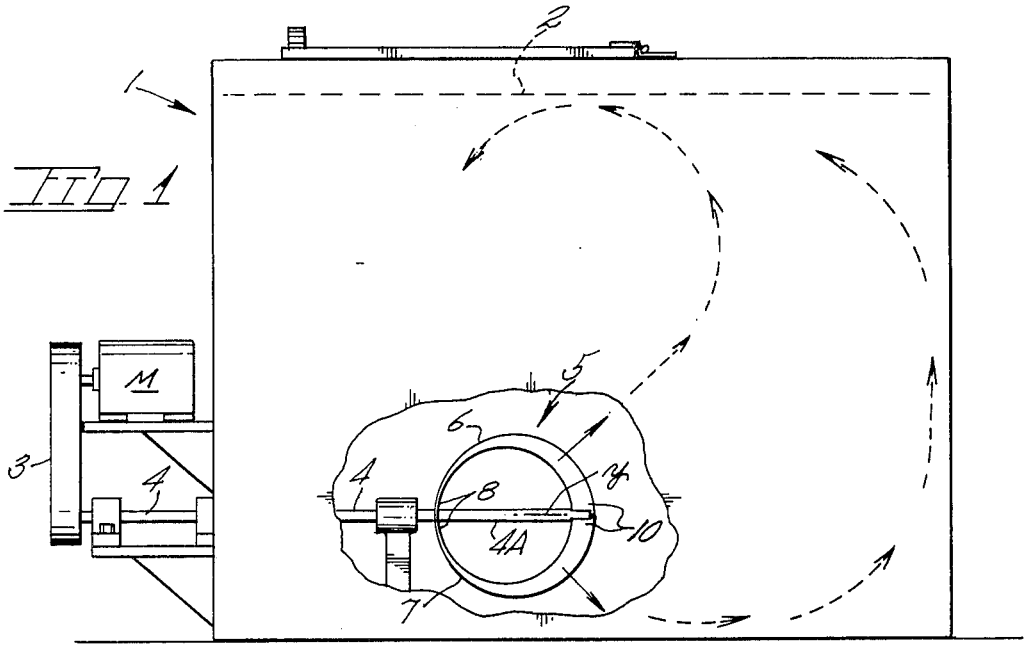
FIG. 1 is a side elevational view of a mixing tank equipped with an impeller embodying the present invention.

In the accompanying drawing wherein applied reference numerals indicate parts similarly hereinafter identified, the reference numeral 1 indicates generally a mixing tank having a fluid level at 2. Such tanks may be for the mixing of liquids or liquids and solids for example.

A power source for the later described impeller may be a motor M and a transmission means 3 which drive an impeller shaft 4 suitably journalled and sealed depending on tank and material requirements.

The impeller is indicated generally at 5 and is a closed shape in side elevation. The impeller may be said to have blade members at 6 and 7 each terminating at ends proximate a central, elongate support member shown as an extension 4A impeller shaft 4.

Figure 2:
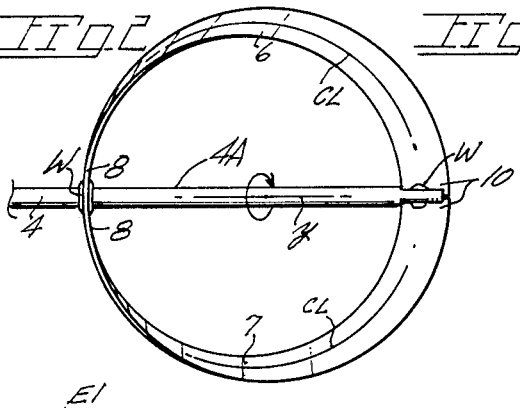
FIG. 2 is a side elevational view of an impeller embodying the present invention.
Figure 3:
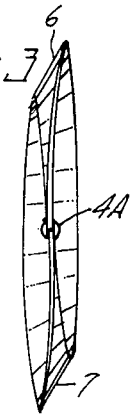
FIGS. 3 and 4 are right hand and left hand end elevational views of FIG. 2.
Figure 4:
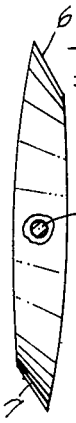

In FIG. 2 the impeller is shown constructed from a single member which simplifies manufacture. It is to be understood that the blade members may be formed from other than a continuous piece of material. Similarly while the blade members are shown directly secured to impeller shaft extension 4A, the same may be affixed to a central support of tubular shape as later described.

Each blade member has ends 8 disposed substantially normal to the rotational axis y of the impeller. The blade members are elongate of curved or arched configuration. Remaining blade member ends at 10 terminating at the central support 4A at a point axially spaced from the first mentioned ends. The curved centerline CL of each blade member may be semicircular or semi-elliptical. Securement to the support member may be by welds at W.

The impeller embodiment best shown in FIG. 2 has central support member 4A passing through one piece blade means and being coterminous with the blade member ends. The support member may be slotted at its end to receive the blade member ends.

The impeller shown in FIG. 2 is intended for counter-clockwise rotation when viewed from the left side as such rotation causes mixing loads on the blade members to be tension loads along the blade member 6 and 7. In an impeller for clockwise rotation the blade members would each be twisted in the opposite direction.

Figure 5:
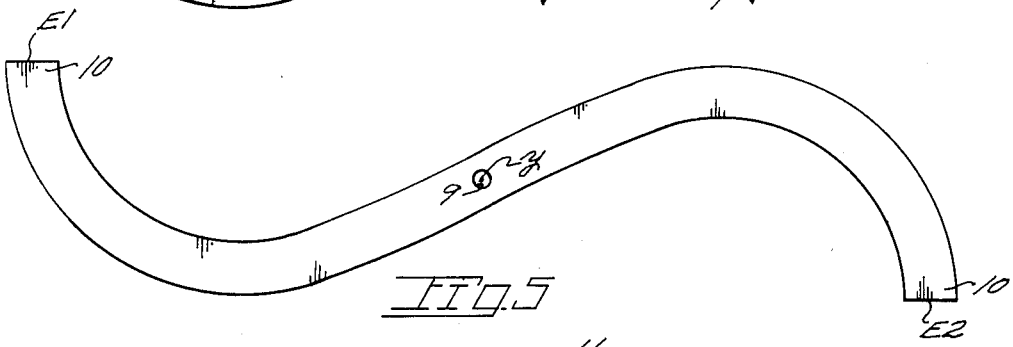
FIG. 5 is a plan view of one form of the present impeller during fabrication of same.

An impeller is preferably formed from metal sheet stock polygonal in section and formed as shown in FIG. 5 with the blade edges E1–E2 in abutment and joined to one another along axis y.

To form a blade from the flexible strip shown in FIG. 5 each end 10 would be lifted through ninety degrees and thence rotated inwardly toward axis y so as to locate the edges E1–E2 in abutment with one another along axis y. The strip is apertured at 9 for mounting purposes.

Figure 6:
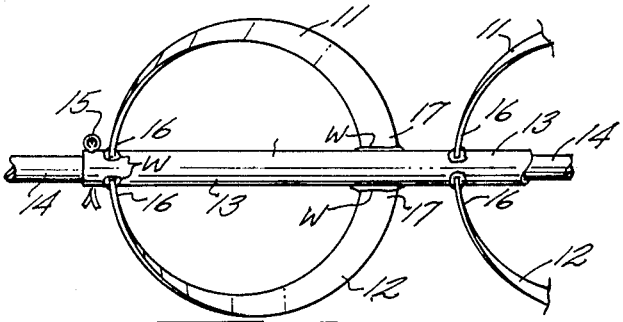
FIG. 6 is a side elevational view of the present impeller used in a ganged fashion.

In FIG. 6 the blade members at 11 and 12 are separate from one another and each secured to a central, elongate support member at 13 which may be tubular and keyed at 15 in place on a drive shaft segment 14. Welds at W secure the blade member ends 16–17 in place. As shown in FIG. 6 the present impeller may be utilized in ganged fashion on a single support member since the discharge is other than an axial flow.

In one application of the present impeller in a 24,000 gallon mixing tank, mixing time was reduced by a factor of 2.5 when compared with a three bladed propellor powered by the same power source.

While I have shown but a few embodiments of the invention, it will be apparent to those skilled in the art that the invention may be embodied still otherwise without departing from the spirit and scope of the invention.

Having thus described the invention, what is desired to be secure in Letters Patent is:

I claim:

1. Propeller construction comprising, an elongate central support member adapted for driven rotation about its major axis, and blade means including elongate curved blade members polygonal in cross section with each blade member secured at its opposite ends directly to said support member at axially spaced locations along said support member, each of said curved blade members having a curved centerline in a plane containing said major axis and additionally being twisted about said centerline.

2. The propellor construction claimed in claim 1 wherein one blade end of each blade member is disposed substantially normal to the support member major axis.

3. The propeller construction claimed in claim 2 wherein the remaining blade end of each blade member is substantially in a plane containing the major axis of the support member.

4. The propeller construction claimed in claim 1 wherein each blade member is twisted about its centerline through approximately ninety degrees.

5. The propeller construction claimed in claim 4 wherein each blade member is twisted in a direction opposite to the twist direction of a remaining blade member.

* * * * *